United States Patent [19]

Berkowitz et al.

[11] 4,122,456

[45] Oct. 24, 1978

[54] PRINTING HEAD AND BRUSH CONFIGURATION FOR A MAGNETIC PRINTER

[75] Inventors: Ami E. Berkowitz, Schenectady; Joseph A. Lahut, Scotia, both of N.Y.

[73] Assignee: General Electric Company, Schenectady, N.Y.

[21] Appl. No.: 794,066

[22] Filed: May 5, 1977

[51] Int. Cl.[2] ..... G03G 19/00

[52] U.S. Cl. ..... 346/74.1; 118/657

[58] Field of Search ..... 346/74.1; 118/657, 658

[56] References Cited

U.S. PATENT DOCUMENTS

| | | | |
|---|---|---|---|
| 2,930,351 | 3/1960 | Giamo | 118/657 |
| 3,141,170 | 7/1964 | Wilkerson | 346/74.1 |
| 3,161,544 | 12/1964 | Berry | 346/74.1 |
| 3,185,777 | 5/1965 | Rheinfrank | 346/74.1 |
| 3,333,572 | 8/1967 | Olden | 118/657 |
| 3,900,001 | 8/1975 | Fraser | 118/658 |

OTHER PUBLICATIONS

IBM Tech. Disc. Bull., vol. 13, #6, Nov. 1970, p. 1643, "Magnetically Addressable Matrix Printing . . . " Hawn.

IBM Tech. Discl. Bulletin, vol. 18, No. 2, Jul. 1975, p. 572, "Fluidized Bed Printer Copier" Romankiw.

*Primary Examiner*—Jay P. Lucas

*Attorney, Agent, or Firm*—Geoffrey H. Krauss; Joseph T. Cohen; Marvin Snyder

[57] ABSTRACT

A magnetic printer includes an elongated comb-like printing head disposed opposite a magnetizable-oxide-bearing surface of a selectively magnetizable moving belt, and adapted to magnetize regions of the belt in a direction transverse to the direction of belt movement; and a magnetic brush for depositing magnetic ink upon the oxide-bearing remaining surface of the belt, with the magnetic brush positioned beneath the printing head, whereby the printing head provides a bearing surface along which the magnetic belt slides. The brush is designed for minimum field at the inking position while the head is designed to have its field direction transverse to the direction of the field of the brush, for minimum field interaction.

9 Claims, 1 Drawing Figure

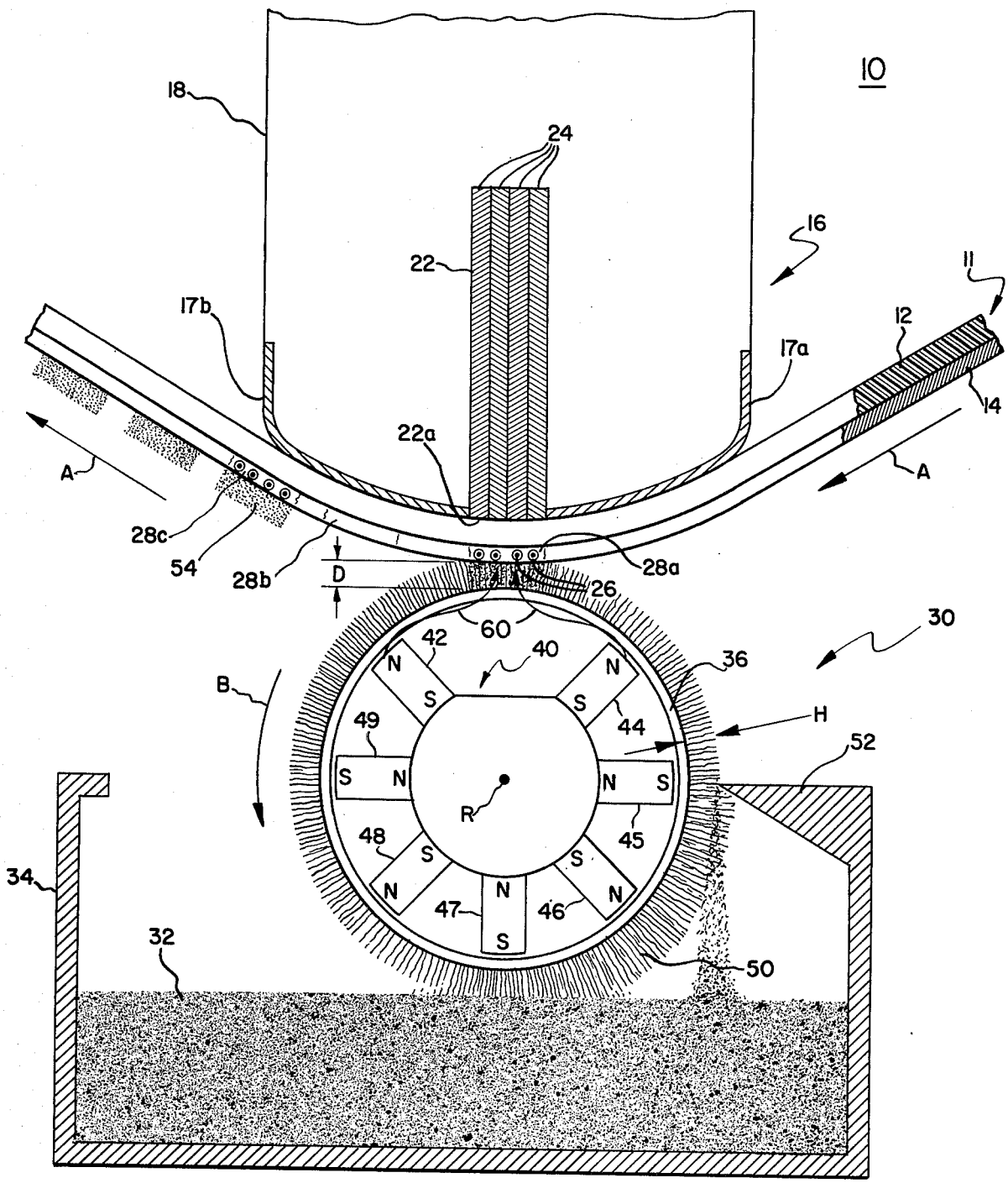
10
18
24
16
22
11
17b
12
17a
14
22a
A
A
28c
54
28b
D
28a
26
60
30
42
40
36
B
H
49
44
52
R
48
45
34
47
46
32
50

PRINTING HEAD AND BRUSH CONFIGURATION FOR A MAGNETIC PRINTER

BACKGROUND OF THE INVENTION

The present invention relates to magnetic printing and more particularly to an improved printing head and magnetic brush configuration for use therein.

Magnetic printing systems are known which utilize a recording head for selectively magnetizing each of a plurality of regions of a magnetizable recording medium for subsequent formation of similar patterns of toner material applied to the medium by a magnetic brush and thence transferred to a hard copy medium, such as paper, to produce printed hard copy in response to electronic signal patterns. As an example, the printing system illustrated in U.S. Pat. No. 3,945,343, entitled "Magnetic Brush for Use in Magnetic Printing", issued Mar. 23, 1976 and assigned to the assignee of the present invention and incorporated herein in its entirety by reference, has a magnetic media drum 14 upon which an image pattern 16 is formed by selective magnetization by a recording head 12; as the drum turns, the selectively magnetized image has dry particulate toner applied to the latent image on the magnetic recording media by a magnetic brush 18 using the exterior surface of the media drum as a bearing surface. The toner image is subsequently transferred to a sheet of paper 26, prior to the drum being cleaned and readied for selective magnetization of a subsequent image thereon. This configuration is undesirable in that both recording head and magnetic brush work upon the same surface of the media and may allow an amount of the toner, not cleaned from the drum, to reach the recording head and reduce the printing field produced thereby and/or to cause background stipling of the recorded image. Further, as both recording head magnetic brush operate upon the same surface of the recording media, the two elements must be positioned in spaced apart relationship, whereby extraneous particles of toner and other materials may be deposited upon the latent image between the time of recording the latent image and applying a toner thereto. This arrangement is further undesirable in that high speed image printing desirably replaces the drum with a driven belt of magnetic recording media (to achieve reproducible recording-head-to-media spacing) and must then require a support member on the opposite side of the belt from the magnetic brush to maintain proper gap relationships and to support the media against the working surface of the magnetic brush. A magnetic printer reducing the number of elements required for facilitating the recording and toner-application functions, to reduce cost and facilitate manufacture, is highly desirable.

BRIEF SUMMARY OF THE INVENTION

In accordance with the invention, an improved recording head and magnetic brush configuration for a magnetic printer having a moving belt of magnetizable recording media, comprises a magnetic recording head adapted to selectively magnetize each of a plurality of magnetizable regions along a line, upon the belt, in a direction substantially transverse to the direction of belt travel; and a magnetic brush disposed adjacent the printing head upon an opposite side of the belt and of the type transferring dry particulate toner to latent images formed on the magnetic recording media of the belt by the opposed recording head. The recording head has a somewhat convex surface over which the recording media belt travels and which provides a bearing surface against which the toner application surface of the brush works. The brush is configured to not only have a minimum field at the inking position, opposite the magnetic image formation portion of the recording head, but also to have minimal field components in a direction transverse to the direction of belt travel and, hence, in the direction of the image-forming field.

In one preferred embodiment, a magnetizable media belt of double layer construction is utilized, with an interior layer, closest to the recording head, of a nonmagnetizable backing material and an exterior, magnetizable layer upon which the toner is deposited. In this preferred embodiment, the recording head is arranged substantially vertically above the axis of a rotating cylindrical magnetic brush, whereby toner particles not adhering to the exterior belt layer fall back into the toner reservoir of the brush to reduce stipling and other undesirable patterning of the image and to prevent the toner from migrating to the interior of the belt and the recording head thereat.

Accordingly, it is an object of the present invention to provide a novel recording head and magnetic brush configuration for a magnetic printer.

It is another object of the present invention to provide a novel recording head-brush configuration having the recording head and brush bearing against opposite sides of a moving belt of magnetic media, with the recording head providing a bearing surface for the tape and a working surface for the magnetic brush.

It is a further object of the present invention to provide a novel opposed recording head-brush configuration having a multi-layered recording media passing therebetween to prevent toner migration to the recording head.

These and other objects of the present invention will become apparent upon consideration of the following detailed description and the drawing.

BRIEF DESCRIPTION OF THE DRAWING

The sole FIGURE is a sectional side view of a preferred embodiment of the novel recording head and brush configuration for a magnetic printer, in accordance with the principles of the present invention.

DETAILED DESCRIPTION OF THE INVENTION

Referring now to the sole figure, a magnetic printer 10 utilizes an endless belt 11 of selectively magnetizable media caused to continuously move (during printing) in the direction of arrows A. Preferably, belt 11 is of a multilayered construction having a first layer 12 of nonmagnetizable backing material which supports a second, outer layer 14 of a magnetizable material. A magnetic recording head 16 includes a pair of support plates **17*a* and 17*b* supporting belt 11 as the belt slides respectively into and out of engagement with the support surface of the recording head. A nonmagnetic member 18 maintains support surfaces 17*a* and 17*b* both against the belt and in spaced-apart relationship, to create a wear surface adjacent each side of a comb-like elongated recording member 22 having a plurality of laminations 24 of elongated shape (extending into and out of the plane of the drawing) and having current carrying conductors disposed within each slot of the comb-like structure, as more fully disclosed in pending U.S. patent application Ser. No. 754,582, entitled "A Transverse Recording Head for Magnetic Printing", filed Dec. 27, 1976 and assigned to the assignee of the present invention, which application is incorporated herein by reference in its entirety. The conductors in each slot run parallel to the direction of tape travel (arrows A) and, when energized to carry a flow of current therethrough, form one of a plurality of linearly-disposed magnetic printing fields aligned in a direction transverse to the direction of tape travel, as illustrated by the magnetic field vectors 26 (of the portion of the field coincident with magnetizable layer 14) shown directed into or out of the plane of the drawing. Thus, recording head 16 not only supports belt 11 during movement of the latter, but also serves to selectively magnetize regions 28 in the magnetizable media layer 14 thereof. Illustratively, a first region 28***a* of layer 14 has been magnetized by recording fields 26, while an adjacent area 28*b*, along a printing line extending into and out of the plane of the drawing and passing beneath the laminated structure immediately prior to passage of areas 28*a* on the next subsequent line thereafter, is unmagnetized, with another region 28*c*, passing over recording head immediately prior to region 28*b*, having been magnetized in a direction transverse to belt travel direction A.

A magnetic brush 30 is positioned substantially opposed to recording head 16 relative to moving belt 11 and thus operates upon the outer surface of the magnetizable layer 14 furthest from comb-like structure 22. The magnetic brush is of a type designed to transfer dry particulate toner 32, maintained within a reservoir 34, to the latent images recorded at the various regions 28 of the belt. Preferably, magnetic brush 30 is of the type described and claimed in the above-referenced U.S. Pat. No. 3,945,343, which has an applicator cylinder 36, of low (preferably zero) magnetic permeability material, rotating about a multi-lobed magnetic prism stator 40 having an axis aligned with the axis of rotation of cylinder 36. Stator 40 includes a pair of magnetic pole lobes 42 and 44 positioned closest to the exterior surface of magnetizable belt layer 14 and disposed in a plane substantially parallel to the end surface 22*a* of the laminated recording comb-like structure 22. As disclosed in the aforementioned patent, pole lobes 42 and 44 have, in one preferred embodiment, like polarity poles at the furthest radially outward extensions thereof; an odd number of additional pole lobes 45–49 are substantially equally spaced about the remaining periphery of stator 40 and have alternating magnetic polarity at their radially outermost extensions, whether energized by permanent magnets or by selectively actuatable electromagnetic means.

Cylinder 36 rotates past reservoir 34 holding the dry, particulate, magnetic toner 32 and toner particles are attracted, by interaction with the poles lobes, to the cylinder surface to form a layer 50 upon the exterior surface of the cylinder, as the cylinder rotates counterclockwise in the direction of arrow B. The height H of the particulate layer is regulated, by a doctor blade 42, to be more than the distance D separating the exterior surface of belt layer 14 at its closest approach to the exterior surface of cylinder 36. In the presence of a magnetized region, e.g. 28*a* or 28*c*, some of the toner is drawn from the toner layer 50 to the exterior surface of belt layer 14, and adheres thereto at regions 54 by magnetic attraction. Toner is not attracted to regions, e.g. 28*b*, which have not been magnetized by the recording head and the exterior surface of belt layer 14 is thus substantially devoid of toner particles adjacent to such regions.

As is well known, the pattern of toner particles adhering to the surface of belt layer 14 may be subsequently transferred to a hard copy medium, such as paper and the like, and permanently affixed thereto to yield an observable replica of the image pattern formed on the belt by recording head 16.

The foregoing combination is particularly advantageous in that brush 30 is not only provided with a stationary surface (support surfaces 17*a* and 17*b* of the printing head) to maintain the belt at a fixed distance from the brush, but also in that the magnetic field 60 of the brush is minimal in the vicinity of the recording gap (between adjacent comb teeth) and the minimal field is aligned in a direction substantially transverse to the recording magnetic field 26 of the recording head. Thus, there is essentially no component of the brush field 60 in the transverse direction in which the magnetic field of the recording head is formed for "writing" magnetized regions onto the belt; magnetic field interaction between recording head 16 and magnetic brush 30 is minimized. Further, due to the laminar construction (laminations 24) of the recording head, if the poles of lobes 42 and 44 are of opposite polarity, there is presented a large demagnetizing coefficient to any magnetic field component of the brush in the longitudinal direction.

In our preferred embodiment, the center of rotation R of brush cylinder 36 (and the center of brush stator 40) is positioned vertically below comb-like structure 22 to allow any extraneous toner particles to fall from applied toner regions 54 directly into toner reservoir 34 for reuse, thus preventing scattering of toner from the reservoir and into the remainder of the system. In addition to the advantageous result of removing the necessity for a separate belt-supporting member opposite the brush, as in the previously known configuration where recording head and magnetic brush are disposed adjacent the same surface of the traveling belt and in spaced-apart relationship, the present configuration of recording head and brush on opposite sides of a traveling belt allows the recording head to be shielded from the migration of toner particles from the exterior surface of the belt to the interior surface of the belt in the vicinity of the recording head and the quality of the recorded image does not deteriorate by reason thereof.

While the present invention has been described with reference to a preferred embodiment thereof, several variations and modifications will now become apparent to those skilled in the art. It is our intent, therefore, to be limited not by the present disclosure but only by the scope of the appending claims.

What is claimed is:

1. In a magnetic printer having a belt of magnetizable recording media moving in a first direction, the combination comprising:

a recording head generating selected ones of a plurality of magnetic writing fields each in a direction substantially transverse to said first direction and in the plane of said belt to selectively magnetize each of a plurality of magnetizable regions of said belt, said recording head including means for supporting a first surface of the belt during belt movement; and magnetic brush means for transferring a toner material to those of said plurality of belt regions magnetized by said recording head, said brush means being positioned opposite said recording head with respect to said moving belt and adjacent a second surface, opposite said first surface of said belt;

said brush means generating magnetic fields aligned substantially transverse to the magnetic fields generated by said recording head at least in the region of said belt being selectively magnetized by said recording head.

2. The combination as set forth in claim 1, wherein said second belt surface and said brush means are spaced a preselected distance apart at the point of closest approach therebetween to cause the toner to be attracted from said brush means to adhere to only those regions of said belt actually magnetized by said recording head.

3. The combination as set forth in claim 1, wherein said belt comprises a second layer of a magnetizable material and a first layer of non-magnetizable material supporting said second layer, said second layer being positioned closest to said magnetic brush.

4. The combination as set forth in claim 3, wherein said brush means generates a magnetic field substantially aligned in said first direction.

5. The combination as set forth in claim 4, wherein said brush means is adapted to generate a magnetic field of minimum magnitude in that portion of said belt being selectively magnetized by said recording head.

6. The combination as set forth in claim 1, wherein said recording head is disposed essentially vertically above said brush means.

7. The combination as set forth in claim 1, wherein said brush means generates a magnetic field substantially aligned in said first direction.

8. The combination as set forth in claim 7, wherein said recording head is disposed essentially vertically above said brush means.

9. The combination as set forth in claim 1, wherein said supporting means comprises at least one plate having a convex surface against which said belt slides.

* * * * *